US006167574B1

(12) United States Patent
Hayashida

(10) Patent No.: US 6,167,574 B1
(45) Date of Patent: Jan. 2, 2001

(54) MOTORCYCLE HELMET WITH FRAGRANCE DEVICE

(76) Inventor: Masamichi Hayashida, Maison Ito 301, 30-8 Okinomiya-cho, Edogawa-ku, Tokyo (JP)

( * ) Notice: Under 35 U.S.C. 154(b), the term of this patent shall be extended for 0 days.

(21) Appl. No.: 09/415,451

(22) Filed: Oct. 8, 1999

(30) Foreign Application Priority Data

Oct. 12, 1998 (JP) ..... 10-324324
Sep. 27, 1999 (JP) ..... 11-309728

(51) Int. Cl.[7] ..... A42B 3/04
(52) U.S. Cl. ..... 2/422; 2/171.2
(58) Field of Search ..... 2/410, 411, 422, 2/424, 171.2, 171.3

(56) References Cited

U.S. PATENT DOCUMENTS 935,832 * 10/1909 Barnes ..... 2/171.1
3,372,407 * 3/1968 Weber, III ..... 5/347
4,503,851 * 3/1985 Braunroth ..... 2/171.2
4,731,885 * 3/1988 Nava ..... 2/424
5,243,708 * 9/1993 Vanuch ..... 2/171.2
5,388,277 * 2/1995 Taniuchi ..... 2/422
5,758,639 * 6/1998 Ikonen ..... 128/201.25

* cited by examiner

*Primary Examiner*—Michael A. Neas
(74) *Attorney, Agent, or Firm*—Koda & Androlia

(57) ABSTRACT

A motorcycle helmet with a shield is provided with a fragrance device, wherein, a fragrance material case is installed inside of the shell or ear cover of the helmet, and, by way of the air flow inhaled during riding through the air inhaler which is installed outside of the shell or ear cover, the fragrance exhaled out of the fragrance material case is sent into the shield through the pipe which is installed to connect the air inhaler, the fragrance material case and the side cushion. As a result the fragrance is sent into the shield by utilizing the air flow as above, and the fragrance obtainable in the shield in such a way is not monotonous and immutable but always variable in accordance with the speed of riding.

3 Claims, 2 Drawing Sheets

MOTORCYCLE HELMET WITH FRAGRANCE DEVICE

BACKGROUND OF THE INVENTION

This invention relates to a motorcycle helmet equipped with a shield or visor (called Shield hereinafter), wherein, the fragrance device is to be installed.

It is common nowadays that the motorcycle helmet is equipped with a Shield, which is quite useful for keeping off wind and/or rain.

However, there are the cases on the other hand that the use of the Shield may cause the riders to feel a sort of oppression and/or to smell some unpleasant odor due to perspiration or the like, and that, for such reasons, there is found many riders who open the Shield upward and do not use it.

Nevertheless, still there will be many opportunities for the riders to wear the Shield just because of convenience or necessity, in spite of a sort of oppression and/or some smell being caused when using the Shield.

Recently it is getting very popular especially among the relatively younger generation that various fragrance are useful in order to find the pleasure of smelling itself, or to deodorize the smell, or to relax the irritating feeling incurred somehow in daily life.

Now, it is rather interesting that the motorcars are furnished with various kinds of fragrance. In most cases, however, the fragrance will be furnished in an easier or simpler way, like just putting beside a bottle containing the liquefied fragrance, then there will be such a phenomenon that sometimes the fragrance causes the drivers' smelling nerves to dull as time goes on, because the fragrance obtainable by such means is monotonous and immutable.

Then, in case the motorcycle helmet with the Shield is devised to be provided with some kind of fragrance device which will furnish the characteristic fragrance for the riders, it is expected to be welcomed by the riders wearing the Shield, though there have not been any precedent of the motorcycle helmet provided with such fragrance device, probably due to the limited space of the motorcycle helmet.

Under such circumstances, this invention is to pursue that the provide such a device in the limited space of the motorcycle helmet to furnish the characteristic fragrance into the Shield, so that the riders wearing the Shield will not only be released from a sort of oppression or unpleasant odor, but also be brought themselves to more pleasant surroundings to wear the Shield.

SUMMARY OF THE INVENTION

As mentioned above, it is common nowadays that the motorcars are furnished with various kinds of fragrance, but just monotonous and immutable fragrance will be obtainable in most cases. Then, the fragrance device (called Device hereinafter) of this invention (called Invention hereinafter) is to be provided with some particular function to furnish the characteristic fragrance for the riders wearing the Shield.

In order to achieve the above purpose, it is devised the by Invention that the fragrance material case (called Case hereinafter), which contains the fragrance material (called Material hereinafter) and exhales the fragrance (called Fragrance hereinafter) therein, is installed inside of the shell (called Shell hereinafter) or the ear cover (called Ear Cover hereinafter) of the motorcycle helmet (called Helmet hereinafter), and that the fragrance exhaled in the Case is sent into the Shield through a pipe (called Pipe hereinafter) by means of the air flow (called Air hereinafter) inhaled through the air inhaler (called Inhaler hereinafter) which is installed outside of the Shell or the Ear Cover of the helmet.

The prominent feature of the Device is that, in the course of the Air being sent from the Inhaler into the Shield through the Pipe which is installed to connect the Inhaler, Case and the side cushion (called Cushion hereinafter), the Fragrance exhaled in the Case is sucked out into the Pipe by the Air and sent into the Shield together with the Air, and that the Fragrance obtained in the Shield is not monotonous and immutable but variable all the time in accordance with the speed of riding.

DESCRIPTION OF THE PREFERRED EMBODIMENTS

Figure 1:
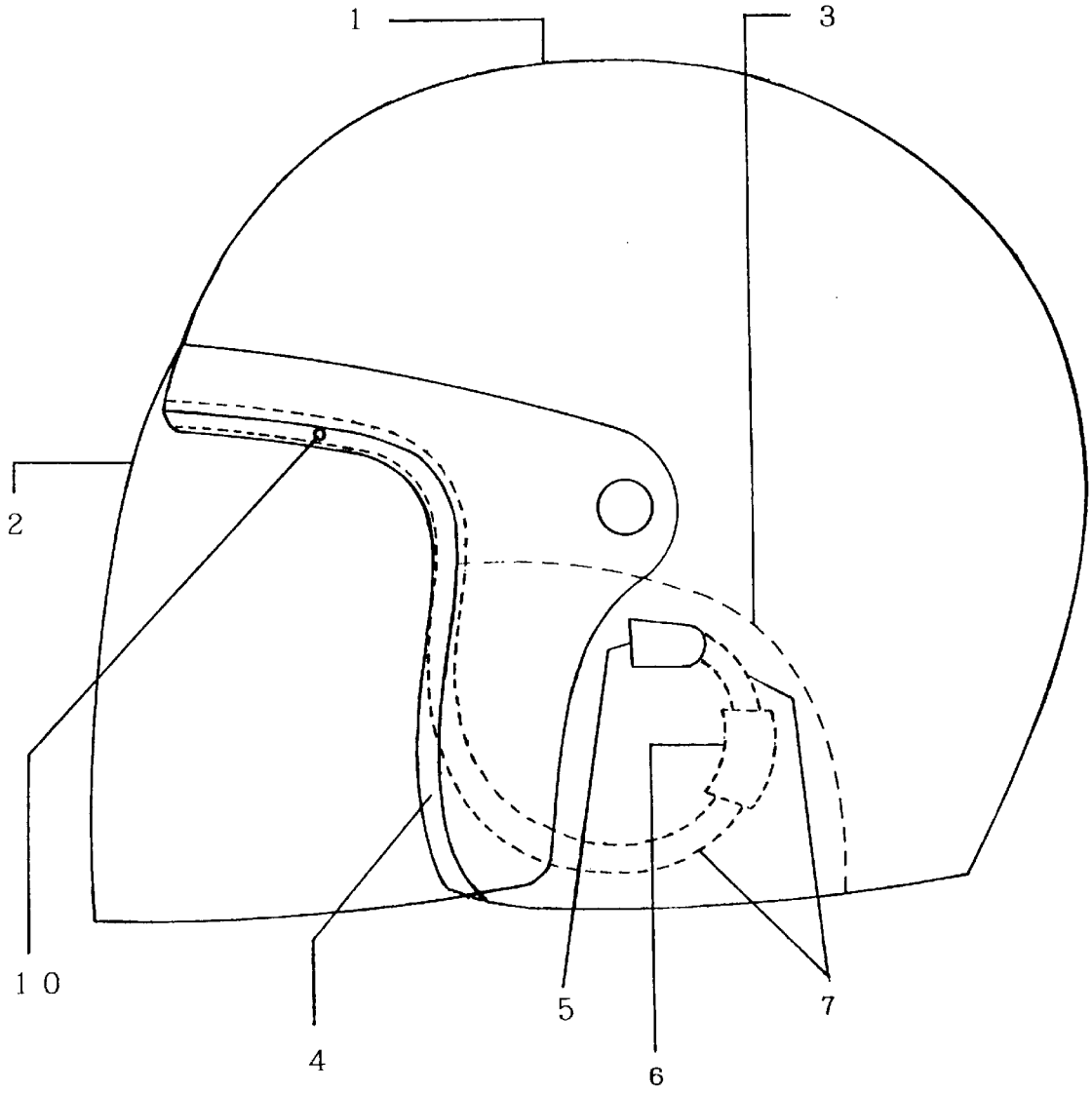
FIG. 1 is the General Arrangement of Helmet with the Shield, and the perspective view of the Device installed in the Helmet.

The examples of Invention are described in detail, referring to the drawings as follows:

As shown in FIG. 1, 1 Shell is the framework of the Helmet, and 2 Shield is installed in front side of 1 Shell. There is 3 Ear Cover as a part of 1 Shell or provided independently sometimes (collectively called Ear Cover hereinafter) and there is the space to hold a riders' ears therein. 4 Cushion is installed to cover a inside of 1 Shell as a shock absorber.

As shown in FIG. 1, 5 Inhaler is installed outside of 3 Ear Cover and it plays the role of inhaling Air during riding. 6 Case is installed inside of 3 Ear Cover and it plays the role of containing 8 Material and exhaling the Fragrance therein. 7 Pipe is also installed inside of 3 Ear cover to connect 5 Inhaler, 6 Case and 4 Cushion, and it plays the role of inhaling Air through 5 Inhaler and sending the Fragrance exhaled out of 6 Case into the Shield together with the Air. The inner diameter of 7 Pipe will be approx. 6 mm and the outer diameter will be 8–9 mm as example.

As shown in FIG. 1, 10 fragrance exhaust hole (called Exhaust Hole hereinafter) is provided throughout 7 Pipe and 4 Cushion, and the Air and the Fragrance are sent together into 2 Shield through 10 Exhaust Hole. In case of a plural number of 10 Exhaust Holes being provided symmetrically, the Fragrance will be spread effectually in 2 Shield. 7 Pipe is shut at its end in order to prevent leakage of the Air and Fragrance therefrom.

Figure 2:
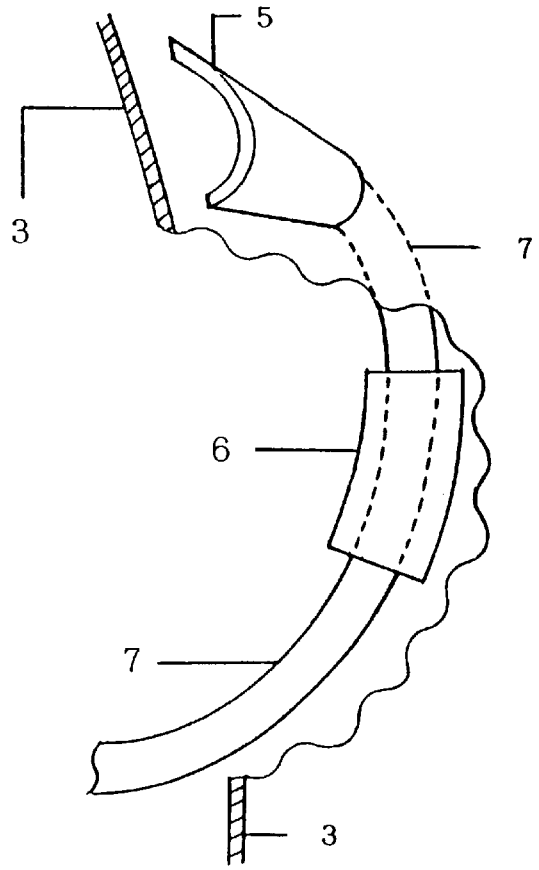
FIG. 2 is a partial and perspective view of the Inhaler installed outside of the Ear Cover, as well as the Case and the Pipe installed inside of the Ear the Cover.

As shown in FIG. 2, in the course of the Air being inhaled through 5 Inhaler and being sent into 2 Shield through 7 Pipe, the Fragrance exhaled in 6 Case is sucked out by the Air into 7 Pipe to be sent into 2 Shield together with the Air (though 2 Shield is not given here).

Figure 3:
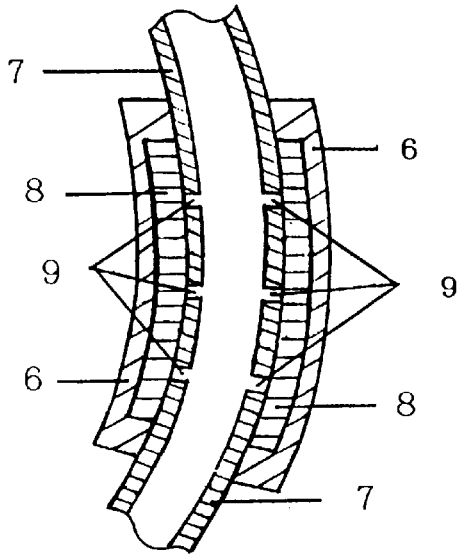
FIG. 3 is the sectional view of Case, Pipe and Material.
Figure 3:
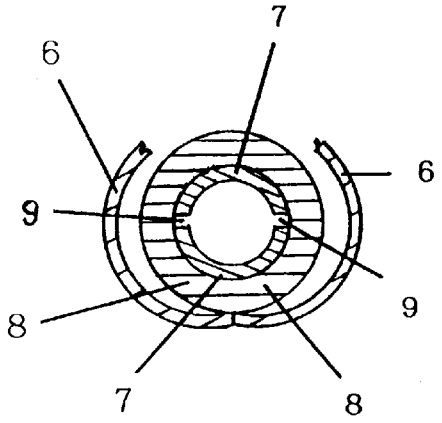

As the inner space of 3 Ear Cover to accommodate 6 Case is limited, the size of 6 Case is expected to be minimized, therefore, as shown in FIG. 3(*a*), taking such method that a material of leather or cloth etc., which is expected to he highly absorbent to contain 8 liquid Material is provided in the aperture between 6 Case and 7 Pipe, then 2–3 mm of aperture between 6 Case and 7 Pipe will be enough so that 6 Case will be able to be accommodated easily in 3 Ear Cover.

As mentioned above, in the course of the Air being sent into 2 Shield through 7 Pipe, the Fragrance exhaled in 6 Case is sucked out into 7 Pipe through 9 fragrance hole (called Hole hereinafter) to be sent into 2 Shield together with the Air, and, in this case, in order to keep the stable flow of the Fragrance into 2 Shield even if the riding speed is increased, the quantity of the Fragrance exhaled out of 6 Case through 9 Hole is needed to exceed relatively the quantity of the Fragrance sent into 2 Shield through 10 Exhaust Hole. In such sense, FIG. 3(*a*) shows an example that 6 of 9 Hole are provided against 2 of 10 Exhaust Hole (which are not given here though) on the premise of the diameters being approx. 2 mm respectively.

8 Material is a volatile substance which must be restored or replaced periodically, and therefore 6 Case is devised to open at need, as shown in FIG. 3(*b*), for restoring or replacing the Material, then the Device will be useful continuously.

The Device is functional as mentioned above, and it presents the features and/or effects, as follows:

The Device is able to be installed in the limited space of the Helmet.

The Fragrance exhaled out of the Case being sent into Shield by utilizing Air inhaled during riding, the Device furnishes such characteristic Fragrance which is always changeable in accordance with the speed of riding, viz. the Fragrance will spread in Shield calmly and freshly while the riding speed is not so high, and it will circulate quickly and freshly in the Shield as the riding speed is increased.

As a result of the above, the Device gives the riders wearing the Shield such advantages that they feel restful to be released from a sort of oppression or smell, furthermore feel to be supplied with a sort of amusement to use the Shield.

In case the riders try to obtain just simple a fragrance in the Shield, it will be sufficient for them to only to supply the Shield with some fragrance material without any particular device, by means of spraying for instance. However, the fragrance obtained in such a way will be just monotonous and immutable regardless of riding or stopping, which may result in an inverse effect sometimes, since such fragrance may be offensive to the rider's nose as time goes on, especially in the limited space of the Shield, while the Device is such functional that the Fragrance will be always changeable according to the riding speed.

The Device will function most effectively to obtain the refreshing Fragrance when riding at the speed of 40–60 km/h since it will not be affected so much by the external conditions, like wind pressure, as long as the said riding speed is kept, though it will still function while riding at fairly higher speed like 80 km/h or more for instance. In such sense, you do not need to be very anxious that the riders will be induced to violate the riding speed limit as the result of your pursuit of more refreshing Fragrance to accelerate the riding.

For more conservative policy, however, it will be possible for the Device to be devised such that the Fragrance in the Shield will not be felt enough when the riding speed is over than 50–60 km for instance. Namely, the Device will be adjustable not to work well in case the riding speed be over 50–60 km/h, to take the following countermeasures in advance.

a) Relatively shallower shape of the Shield is adopted, so that the Fragrance is liable to flow out of the Shield owing to the influence by the increased wind pressure, and/or b) The number of Holes is decreased relatively against the number of Exhaust Holes, so that the supply of the Fragrance exhaled out of the Case is not able to catch up to the increased speed and the quantity of the Air to be inhaled through the Inhaler and to be sent into the Shield as a result of increased speed of riding.

The Device is fundamentally functional during riding. Nevertheless, when halting for a short stop to wait for a traffic light for instance, the Fragrance will be reduced in Shield as if the wind is lulled gradually, and, owing to its aftertaste, still the riders will not oppressed.

There will be the case that some smell, such as smell caused by perspiration or the like, is smelt in the Shield of the Helmet used for a relatively longer time. Then, such smell will be able to be eliminated by the Air and Fragrance to be sent into the Shield during riding.

What is claimed is:

1. A motorcycle helmet equipped with a shield, which is provided with a fragrance device, wherein, a fragrance material case, which contains a fragrance material and exhales the fragrance, is installed inside of a shell of the helmet, and the fragrance exhaled in the said fragrance material case is sent into the shield through a pipe by means of air flow inhaled during riding through an air inhaler which is installed outside of the shell.

2. A motorcycle helmet according to the above claim 1, wherein, the pipe is installed to connect the air inhaler, the fragrance material case and a side cushion, so that the fragrance exhaled in the fragrance material case is sucked out into the pipe to be sent into the shield through the said pipe, by means of the air flow inhaled into the said pipe through the air inhaler during riding.

3. A motorcycle helmet equipped with a shield which is provided with a fragrance device, wherein, a fragrance material case, which contains a fragrance material and exhales the fragrance, is installed inside of an ear cover of the helmet, and the fragrance exhaled in the fragrance material case is sent into the shield through a pipe by means of air flow inhaled during riding through an air inhaler which is installed outside of the ear cover.

* * * * *